United States Patent [19]

Trilling

[11] 4,014,548

[45] Mar. 29, 1977

[54] WORD GAME HAVING SINGLE AND MULTIPLE LETTER TILES

[76] Inventor: Minnie Hess Trilling, 21 E. Drive, Marvin Gardens, Margate, N.J. 08402

[22] Filed: Oct. 9, 1975

[21] Appl. No.: 621,155

[52] U.S. Cl. ..... 273/135 D; 273/130 E

[51] Int. Cl.[2] ..... A63F 3/00

[58] Field of Search ..... 273/135 D, 130 E, 134 C, 273/136 W, 146, 152.7 R, 152.7 A; 35/35 R, 35 J

[56] References Cited

UNITED STATES PATENTS

| | | | |
|---|---|---|---|
| 1,686,237 | 10/1928 | Hoexter | 273/137 R |
| 2,491,883 | 12/1949 | Welch | 273/146 X |
| 2,693,961 | 11/1954 | Ripley | 273/134 C |
| 3,140,876 | 7/1964 | Moss | 273/137 R |
| 3,393,914 | 7/1968 | Hill | 273/135 D |
| 3,606,336 | 9/1971 | Krause | 273/135 D |
| 3,744,154 | 7/1973 | Pott | 35/35 R |
| 3,903,617 | 9/1975 | Evans | 35/35 J |

*Primary Examiner*—William H. Grieb
*Attorney, Agent, or Firm*—Lowe, King, Price & Markva

[57] ABSTRACT

A word game includes multiple-letter tiles as well as single-letter tiles which are placed on successive spaces on a playing board. In order to receive score points, each player attempts to compose words on his own playing board on which is printed a single row of letter spaces. One of the letter spaces, designated as a "master space", has placed thereon a randomly selected multiple-letter tile. Words are composed by locating single-letter tiles in successive letter spaces on the board so that the single-letter tiles merge with the multiple-letter tile. Each of the letter spaces is assigned a score point value, the magnitude of which depends upon distance to the master space. The score point value of a composed word is equal to the sum of the assigned score point values of the starting and ending spaces of the word. Bonus points are awarded when a joker tile used in composing a word falls on a "joker" space. A timer is provided to limit the time permitted a player for composing a word in order to speed up the playing action.

7 Claims, 8 Drawing Figures

SCORE VALUE = 25 + 5 = 30

SCORE VALUE = 4

SCORE VALUE = 5 + 3 = 8

WORD GAME HAVING SINGLE AND MULTIPLE LETTER TILES

BACKGROUND OF THE INVENTION

The present invention relates generally to word games, and more particularly to a word game having multiple letter as well as single letter tiles for composing words.

Numerous word games have been previously developed for play by groups of individuals. These games, such as Scrabble, are both educational and informative insofar as they require the players to compose words formed with a limited number of letter tiles and board space. For example, in Scrabble, words are formed using single-letter tiles selectively placed in spaces on a two-dimensional matrix printed on a playing board. Scoring is determined by point values assigned to the letter tiles as well as bonuses assigned to some of the letter spaces, i.e., double and triple letter spaces. The point value assigned to a letter depends upon the frequency of use of the letter in the language. For example, an *x* has a higher assigned value than does *e*. While Scrabble has enjoyed substantial commercial success, word formation is relatively simple because each tile contains only one letter. Furthermore, scoring is primarily based on letter usage, rather than on word length.

OBJECTS OF THE INVENTION

Accordingly, it is one object of the present invention to provide a word game which is challenging to players.

Another object of the present invention is to provide a word game which encourages formation of long words by basing score value on word length.

Another object of the present invention is to provide a word game using multiple-letter tiles as well as single-letter tiles, with only one randomly selected multiple-letter tile being included in the composed word.

Another object of the present invention is to provide a word game which is simple to play and easy to manufacture.

SUMMARY OF THE INVENTION

In accordance with the invention, a word game comprises a number of multiple-letter alphabetic tiles as well as single-letter alphabetic tiles located by a player on successive letter spaces on a printed playing board. Each player has his own playing board having printed thereon a single row of letter spaces. One of the spaces (termed "master space") receives a randomly picked multiple-letter tile (termed "master tile"). A word is formed by the player by adding single-letter tiles to the master-letter tile so as to compose a word. A score point value is assigned to each letter space on the board with the magnitude of the score point value depending on its distance from the master space. The score point value of a word is determined by adding together the point values assigned to the letter spaces corresponding to the starting and ending letters of the word. Score point values may also be assigned to the master tiles.

Some of the letter spaces are designated as "joker spaces". If a single-letter tile, designated as a "joker", falls on a joker space in a composed word, a bonus value is added to the score point value of the word. Players obtain high scores by formulating long words with a maximum number of joker tiles landing on joker spaces.

The master tile, drawn arbitrarily by each player, must be used in the formation of a word. During play, single-letter tiles are either used in word formation, or discarded for new single-letter tiles. Chips are collected according to the point value of the composed word but a chip is lost for each single-letter tile discarded. To speed up playing action, a timer is provided to limit the time permitted a player to formulate a word.

DETAILED DESCRIPTION OF A PREFERRED EMBODIMENT

Figure 1A:
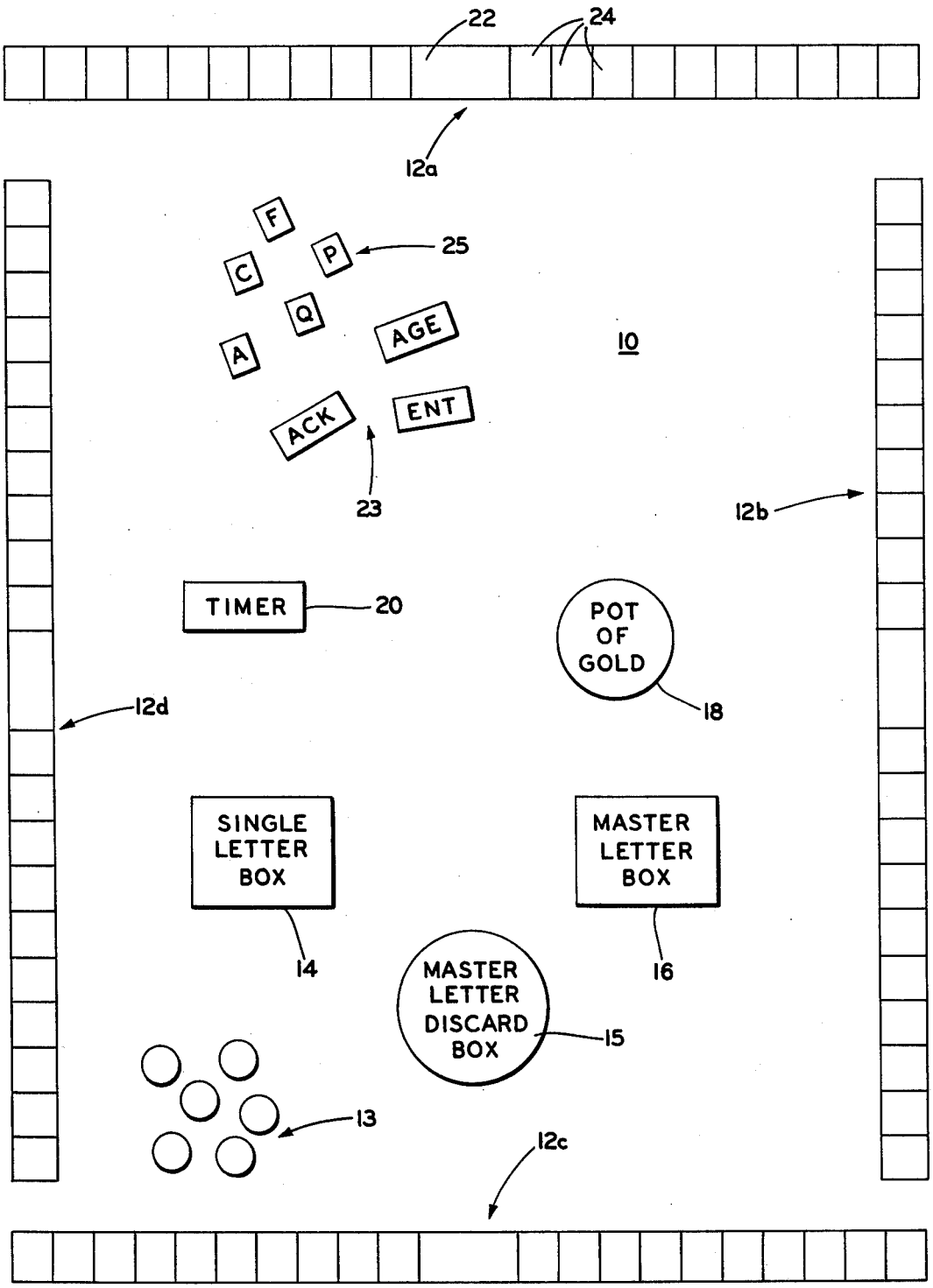
FIG. 1A is an illustration of a game playing area containing four playing boards as well as the game accessories in accordance with the invention.

Referring to FIG. 1A, a playing area 10 contains four playing boards 12A–12D, in accordance with the invention, along with game accessories comprising single letter box 14, master letter box 16, master letter discard box 15, pot-of-gold chip container 18, timer 20 and chips 13. Each of playing boards 12A–12D is made up of a single row of letter spaces including a single master-letter space 22 and ten single-letter spaces 24 on each side of the master-letter space. Single-letter spaces 24 are substantially square, while master-letter space 22 is rectangular and has a width that is approximately twice as large as its height.

It should be understood that the number of letter spaces 24 provided on playing boards 12A–12D is arbitrary and the boards could contain greater or fewer than twenty single-letter spaces each, if desired. Furthermore, although playing boards 12A-12D are shown as being a separate board for each player in the preferred embodiment, it is also to be understood that the playing boards could be printed on a single large board or mat, and the number of boards 12A–12D could be greater or fewer than four, as shown. However, at least two playing boards are required; the largest number of playing boards usable in the game depends upon the number of single and multiple letter tiles provided.

In addition to playing boards 12A–12D, the word game of the present invention includes a relatively large number (e.g., 200) of single-letter tiles, each containing an alphabetical letter for placement on single letter-spaces 24 of playing boards 12A–12D, and a number (e.g., 48) of master tiles each containing three different alphabetical letters for placement on master space 22. Single-letter tiles 25 are square in configuration while master letter tiles 23 are rectangular having a width that is twice its height to correspond, respectively, to single-letter spaces 24 and master-space 22. The three letters contained on master tile 22 are letter sets frequently arising in English words, such as NCH, RCH, RSE, TCH, ENT, ACK, AGE, PAT, ANE, INT, etc. As discussed in detail below, up to ten single-letter tiles are combined with the master-letter tile on each playing board 12A–12D to formulate a word and receive chips 13 according to a score point value.

Figure 1B:
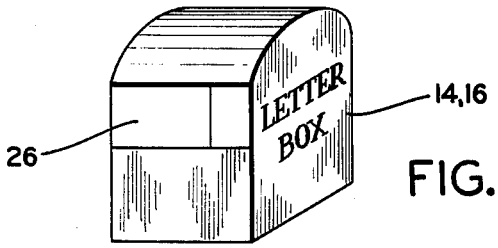
FIG. 1B is a perspective view of a letter box used for storing single-letter tiles.

During playing of the game, the single-letter tiles are stored in single-letter box 14 while the master-letter tiles are stored in master-letter box 16. Referring to FIG. 1B, single-letter box 14 and master-letter box 16 may be formed in the shape of a mailbox container having the opening 26 to the box raised above board level so that tiles can be easily reached, yet out of sight of the players.

Pot-of-gold 18 is preferably a gold colored bowl for storing any playing chips 13 that are discarded during the course of the game.

Master letter discard box 15 (FIG. 2C), preferably in the form of a trash can receptacle, is used for storing master letter tiles during playing of the game.

Figure 1C:
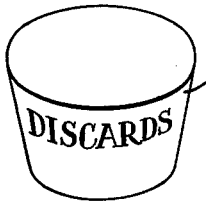
FIG. 1C is a perspective view of a discard box used for storing discarded multiple (master) letter tiles.

Although not shown in FIG. 1, boxes 14, 15 and 16 as well as pot-of-gold 18 may be mounted on a conventional "lazy susan" type tray in the center of the playing board for easy access by all players.

Timer 20 is a conventional timer which provides an audible alarm a predetermined duration of time after it has been actuated. For example, in the preferred embodiment, timer 20 is a three-minute mechanical timer which rings a bell three minutes after it has been push-button actuated. The purpose of timer 20 is to limit the amount of time provided to a player for forming a word. This intensifies the action of the game and reduces its overall time duration.

PLAYING THE GAME

Figure 3:
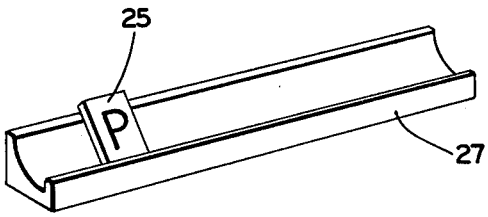
FIG. 3 is a perspective view of a tile rack used in playing the game.

To begin the game, each player draws a single-letter tile 25 from single-letter box 14. The player drawing the highest letter is the first to play. The single-letter tiles in letter box 14 are then shaken up, and each player draws ten single-letter tiles 25 from the letter box for placement on the player's rack 27 (see FIG. 3).

Each player also draws a master-tile 23 from master letter box 16, and places the master tile on master space 22 on his board 12. The player is then committed to use the master tile 23 drawn but may formulate a word with any or all of the single-letter tiles 25 in his rack 27 in the time allotted. After a player has drawn his master and ten single tiles, if he does not find a satisfactory play in his hand, he may discard up to three tiles (or more) and he puts one chip for each tile discarded into the "pot-of-gold". Then, if he still is not satisfied, he may pass until his next turn when he may follow the same procedure of exchanging his 1–3 single tiles. Preferably, the player is permitted to pass on one round only, so that the player must compose a word on his next turn. On his next turn, the player may again discard up to three single-letter tiles 25, but must then compose a word. If desired, the rules may be modified to permit exchanging an unwanted master letter tile 23 for another or passing more than one time with a penalty (e.g., depositing a predetermined number of point chips 13 in pot-of-gold 18). Further, bartering letter tiles among players may be permitted.

Each time a player composes a word using some or all of his single-letter tiles in addition to his master letter tile, he collects point (or chips) from each player according to the value of the word composed, as described below. After each word is formulated, the player discards his master tile 23 to discard box 15 and his single-letter tiles 25 making up the word to single letter box 14. He then draws a new master tile and single-letter tiles so that he always has ten single-letter tiles and one master tile on his rack 27.

The game ends when the last of master tiles 23 drawn from master letter box 16 is played. The player with the greatest number of chips 13 at the end of the game receives the additional chips stored in the pot-of-gold 18 as a bonus. In case of a tie, the chips in pot-of-gold 18 are divided between the tie winners.

Optionally, master letter tiles 23 can be assigned a point value in accordance with the frequency with which the three-letter combination appears in the English language. For example, referring to FIG. 4, tile "NCH", being relatively rare is assigned the value four, while the easier to use tile "AGE" is assigned the value two.

WORD SCORING

Figure 2A:
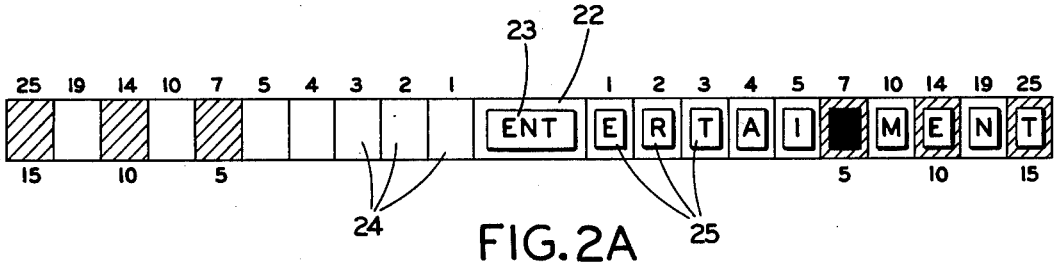
FIG. 2A-2C illustrate playing boards respectively having three different words formulated thereon, for illustrating score value computation.
Figure 2B:
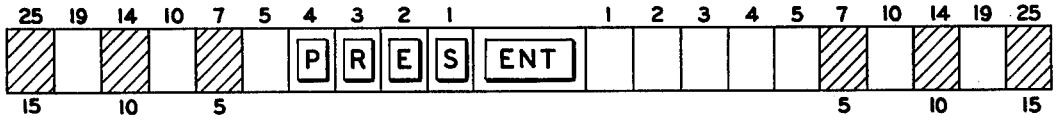
Figure 2C:
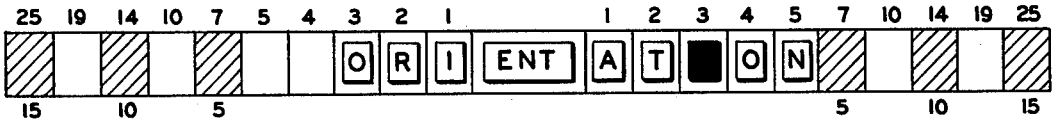

Referring to FIGS. 2A–C, a playing board 12 is shown in more detail, along with words formed thereon. Above each single letter space 24 is a numeral representing the point value assigned to that space. As shown, the point values increase away from each side of master letter space 22 in a 1–2–3–4–5–7–10–14–1-9–25 sequence. The monotonically increasing sequence increases linearly between square 1 and square 5, but increases more rapidly between spaces 6–10. Accordingly, it is advantageous to compose long words, and particularly to compose words that extend beyond the fifth single letter space with respect to either side of master letter space 22.

The single letter spaces having point value designations 7, 14 and 25 are shaded indicating that they are joker spaces. Below the joker spaces are numerals representing bonus values assigned to those spaces if a single letter joker tile is played on the joker spaces in the formulated word.

For example, assuming that the particular master letter tile 23 drawn is ENT, computation of score values for the words "entertainment", "present", and "orientation" respectively is shown in FIGS. 2A–C. In FIG. 2A, the word entertainment ends with the letter *t* on the rightmost space on board 12, having a value 25. There is a joker tile (indicated as black) on the five-point joker space, and the joker tile represents the letter *n*. As shown, the score value of entertainment is the value of the rightmost single letter space 25 added to the five-point bonus for the joker tile, and the total point value is 30.

In FIG. 2B, the word present extends to the left of master letter space 22 to the fourth single-letter space which has a value 4. There are no joker tiles landing on joker spaces, so that the score value is 4, as shown.

In FIG. 2C, the word orientation extends both to the left and right sides of master letter space 22. In such a case, the score value of the word is equal to the score value of the letter spaces associated with the first and last single letter tiles of the word. In orientation, the first letter *o* is on a space having a score value of 3, while the last letter *n* is on a single-letter space having a score value of 5. Although a joker tile representing the letter *i* is used, since it has not landed on a joker space, the word receives no bonus. Therefore, the score value of orientation is $5 + 3 = 8$.

Figure 4:
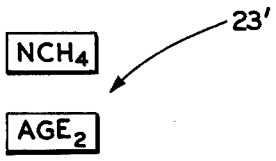
FIG. 4 is an illustration of two master tiles in accordance with another embodiment of the invention.

It is noted that the computations set forth above are based on master letter tile 23 being assigned no point value. Where master letter tile 23 is assigned a point value, as shown in FIG. 4, the assigned point value is added to the point value of the formulated word. For example, a word using master letter tile "AGE" receives an additional point value of two, while a word using master tile "NCH" receives an additional point value of four.

Although in the preferred embodiments, only some of the single letter spaces are joker spaces, if desired, all of the single letter spaces may be designated as joker spaces with different bonus values. The bonus values may increase with word length, or may be arbitrary.

Although an illustrative embodiment of the present invention has been described herein with reference to the accompanying drawings, it is to be understood that the invention is not limited to those precise embodiments and that various changes and modifications may be effected therein by one skilled in the art without departing from the scope or spirit of this invention.

What is claimed is:

1. A word game comprising a first number of single-letter alphabetic tiles; a second number of multiple-letter alphabetic tiles; at least two discrete playing boards located in a playing area, each of said boards having a single row of letter spaces, one of said letter spaces being a multiple-letter space arranged to receive one of said multiple letter tiles and the remaining spaces being single-letter spaces, successive single-letter tiles placed in successive single-letter spaces and said multiple-letter tile placed in said multiple-letter space forming a word, the score value of said word corresponding to the length thereof with respect to said multiple-letter tile, wherein the score values corresponding to said single-letter spaces are printed on the playing boards at respective single-letter spaces, said score values increasing in both of opposite directions with respect to said multiple-letter space.

2. The word game of claim 1, wherein a score value is assigned to each of said multiple letter tiles, the score value being related to the frequency of usage in language of the multiple letter combination printed on said each tile.

3. The word game of claim 1 further including a third number of joker tiles, and some of said single-letter spaces being joker spaces, a bonus being added to said score value if a joker tile incorporated in said word is located on a joker space.

4. The word game of claim 1, including a timer for limiting the time permitted a player for forming said word.

5. A word game comprising a playing area having at least two rows of successive letter spaces, each of said rows corresponding to an individual player and including only one multiple-letter space and a plurality of single-letter spaces; a first number of single-letter tiles for placement on said single-letter spaces; and a second number of multiple-letter tiles for placement on said multiple-letter spaces, said multiple-letter tiles containing three-letter combinations commonly occuring in words, wherein a word is composed using said one multiple-letter tile with at least one single-letter tile, a score point value being assigned to said composed word according to its length, wherein the score point values corresponding to said single-letter spaces are printed at respective single-letter spaces, said score point values increasing in both opposite directions with respect to said multiple-letter spaces.

6. The word game of claim 5, wherein some of said single-letter spaces are joker spaces, and said single-letter tiles include a number of joker tiles, bonus points being awarded whenever a joker tile falls on a joker space in a composed word.

7. The word game of claim 5, wherein a score value is assigned to each of said multiple letter tiles, the score value being related to the frequency of usage in language of the multiple letter combination printed on said each tile.

* * * * *